US011891160B2

(12) United States Patent
Van Peteghem et al.

(10) Patent No.: US 11,891,160 B2
(45) **Date of Patent: *Feb. 6, 2024**

(54) SHIP WITH SAIL PROPULSION

(71) Applicant: AYRO, Paris (FR)

(72) Inventors: Marc Van Peteghem, Paris (FR); Nicolas Sdez, Paris (FR)

(73) Assignee: AYRO, Paris (FR)

( * ) Notice: Subject to any disclaimer, the term of this patent is extended or adjusted under 35 U.S.C. 154(b) by 198 days.

This patent is subject to a terminal disclaimer.

(21) Appl. No.: 17/311,178

(22) PCT Filed: Dec. 6, 2019

(86) PCT No.: PCT/IB2019/060529

§ 371 (c)(1),
(2) Date: Jun. 4, 2021

(87) PCT Pub. No.: WO2020/115717

PCT Pub. Date: Jun. 11, 2020

(65) Prior Publication Data

US 2022/0033044 A1 Feb. 3, 2022

Related U.S. Application Data

(63) Continuation-in-part of application No. 16/307,880, filed on Dec. 6, 2018, now Pat. No. 10,906,620.

(51) Int. Cl.
*B63H 9/061* (2020.01)
*B63H 9/10* (2006.01)

(52) U.S. Cl.
CPC ..... *B63H 9/061* (2020.02); *B63H 9/0635* (2020.02); *B63H 9/1021* (2013.01); *B63H 2009/105* (2013.01)

(58) Field of Classification Search
CPC .... B63H 9/061; B63H 9/0621; B63H 9/0635; B63H 9/1021; B63H 9/1035; B63H 2009/105; B63H 9/1092
See application file for complete search history.

(56) References Cited

U.S. PATENT DOCUMENTS 2,484,687 A 10/1949 Carl, Jr.
3,332,383 A 7/1967 Edward
(Continued)

FOREIGN PATENT DOCUMENTS

DE 19614150 10/1996
EP 0057649 8/1982
(Continued)

OTHER PUBLICATIONS

International Preliminary Report on Patentability received for PCT Patent Application No. PCT/IB2017/056927, dated May 23, 2019, 12 pages (6 pages of English Translation and 6 pages of Original Document).

(Continued)

*Primary Examiner* — Ajay Vasudeva
(74) *Attorney, Agent, or Firm* — WOMBLE BOND DICKINSON (US) LLP

(57) ABSTRACT

A double airfoil mounted on a structure controlled angularly around a generally vertical axis. The double airfoil includes a fore flap and an aft flap at least one of which has a fore-to-aft asymmetry. Each flap includes a series of shape members distributed in height, wherein the structure includes a fore mast and an aft mast connected by a boom member and a gaff member. The shape members of the fore flap are traversed by the fore mast while being able to turn around an axis defined thereby, while the shape members of the aft flap are traversed by the aft mast while being able to turn around an axis defined thereby. The aft mast is twistable, the shape members of the aft flap are rotationally (Continued)

locked to the aft mast, and the controller can act on the bottom and the top of the aft mast.

16 Claims, 14 Drawing Sheets

(56) References Cited

U.S. PATENT DOCUMENTS

| | | | | |
|---|---|---|---|---|
| 4,437,426 | A | 3/1984 | Latham | |
| 4,561,374 | A | 12/1985 | Asker | |
| 4,649,848 | A | 3/1987 | Belvedere | |
| 4,682,557 | A | 7/1987 | Magruder et al. | |
| 4,685,410 | A | 8/1987 | Fuller | |
| 4,757,779 | A | 7/1988 | Graveline | |
| 4,848,258 | A | 7/1989 | Priebe | |
| 4,895,091 | A | 1/1990 | Elmali et al. | |
| 4,982,679 | A | 1/1991 | Walker | |
| 5,313,905 | A | 5/1994 | Calderon | |
| 5,540,406 | A | 7/1996 | Occhipinti | |
| 5,868,092 | A | 2/1999 | Milidragovic | |
| 6,431,100 | B2 | 8/2002 | Abshier | |
| 7,574,972 | B1 | 8/2009 | Fairchild | |
| 8,413,598 | B2 | 4/2013 | Ouchi et al. | |
| 8,635,966 | B2 | 1/2014 | Bachmann | |
| 9,308,979 | B2 | 4/2016 | Mostoviy | |
| 10,906,620 | B2 * | 2/2021 | Van Peteghem ..... | B63H 9/1021 |
| 2012/0132117 | A1 | 5/2012 | Bermudez et al. | |
| 2018/0072394 | A1 | 3/2018 | Bermudez et al. | |

FOREIGN PATENT DOCUMENTS

| | | | |
|---|---|---|---|
| EP | 0083432 | | 7/1983 |
| EP | 0328254 | A1 | 8/1989 |
| EP | 0927682 | A2 | 7/1999 |
| EP | 1520781 | A1 | 4/2005 |
| EP | 2202144 | A1 | 6/2010 |
| EP | 3299275 | A1 | 3/2018 |
| FR | 2567098 | | 1/1986 |
| FR | 2617117 | A1 | 12/1988 |
| FR | 2643329 | A1 | 8/1990 |
| FR | 2771705 | A1 | 6/1999 |
| WO | 92/18381 | A2 | 10/1992 |
| WO | 97/42072 | A1 | 11/1997 |
| WO | 2010/007377 | A2 | 1/2010 |
| WO | 2012/020441 | A2 | 2/2012 |
| WO | 2018/087649 | A1 | 5/2018 |

OTHER PUBLICATIONS

International Search Report and Written Opinion received for PCT Patent Application No. PCT/IB2019/060529, dated May 7, 2020, 8 pages.

International Search Report received for PCT Patent Application No. PCT/IB2017/056927, dated Mar. 29, 2018, 7 pages (3 pages of English Translation and 4 pages of Original Document).

Lombardi et al., "Optimization of a Wing-Sail shape for a small boat", STAR Global Conference, Vienna, Mar. 17-19, 2014, pp. 1-57.

Written Opinion received for PCT Patent Application No. PCT/IB2017/056927, dated Mar. 29, 2018, 5 pages of Original Document Only.

* cited by examiner

SHIP WITH SAIL PROPULSION

FIELD OF THE INVENTION

The present invention relates generally to sail propulsion, and more specifically to a new type of propulsion airfoil for cruise boats and working ships.

State of the Art

The prior literature relating to rigid airfoils for propulsion of natives is abundant.

Thus, in particular rigid or semi-rigid airfoils with two flaps, with which in particular to give the airfoil an adjustable camber are known from documents U.S. Pat. Nos. 3,332,383 A, 4,685,410 A, 5,313,905 A and 8,635,966 B1.

However, these known airfoils have significant problems when it comes to making a droppable sail and further do not allow reefing. Thus existing airfoils with two flaps most often have a shrouded mast and control of the airfoil is done by means of lanyards which constitute both a sheet which forces the airfoil camber and also a fixed linkage which drives the second flap so as to make it reach all or part of the camber at the base of the wing, so as to generate a washout as needed. Also, the relative movement of the second flap relative to the first flap is in general achieved by rotation from an axis located inside the profile of the first flap, which is not optimal from the performance perspective and makes the implementation of a droppable or reefable airfoil delicate or even impossible.

Additionally, document U.S. Pat. No. 4,848,258 A describes a sail system with three sails and three respective masts, where the structures comprising the two outer masts are capable of turning near the central mast. The sail system comprises lift members which belong more to sails than to airfoils. The fore and aft gaffs and booms are capable of forced turning around an axis formed by the main mast.

On another hand, document EP 0,328,254 A1 describes a double airfoil sail in which the aft airfoil pivots around an axis located inside the volume of the fore airfoil.

A sail is also known from document U.S. Pat. No. 4,561,374 A which is similar to a single airfoil with variable camber. The structure bearing this airfoil pivots at a single mast which passes through the rear part of the airfoil and at which the camber is achieved.

Also known by WO 2018/087649 is an at least partially wind-propelled ship, comprising a double airfoil mounted on a structure controlled angularly around a generally vertical axis depending on conditions, where the double airfoil comprises a fore flap and an aft flap at least one of which has a fore-to-aft asymmetry and separated by a slit, where each flap comprises a series of shape members distributed in height, wherein said structure comprises a fore mast and an aft mast connected by a boom member and by a gaff member, wherein the shape members of the fore flap are traversed by the fore mast while being able to turn around an axis defined thereby, wherein the shape members of the aft flap are traversed by the aft mast while being able to turn around an axis defined thereby, and wherein said structure is capable of turning on an axis of rotation formed by the fore mast.

Brief Description of the Disclosure

The aim of the present disclosure is to provide improvements to the ship as defined above.

According to a first improvement, the aft mast is twistable, the shape members of the aft flap are rotationally locked to said aft mast, and the controller is capable of acting on the bottom and the top of the aft mast.

According to a second improvement, each of the fore and aft flaps comprise a top member capable of sliding along its respective mast independently of the other, and the ship further comprises two halyards capable of independently hoisting, hauling down and reefing the fore and aft flaps.

According to a third improvement, the fore flap is displaceable over an angular interval defined so as to be angularly offset relative to the median plane formed by the axes of rotation of the two flaps, the ship further comprises a controller for controlling the angulation of the aft flap relative to said median plane, the controller being capable of causing distinct angular displacements of a lower region and an upper region of the aft flap and comprising a first actuator acting near a lower region of the aft flap and a second actuator located in the lower region of the airfoil and acting near an upper region of the aft flap via a transfer mechanism passing in one of the masts, the gaff member belonging to a gaff assembly comprising said gaff member and a member capable of sliding along the at least one mast and secured in translation with the upper end of the fore flap and/or the upper end of the aft flap, to make at least one among a droppable and/or a reefable fore flap and/or aft flap, and the transfer mechanism combined with the second actuator comprises transfer members mounted on the sliding member of the gaff assembly.

The ship according to either of these improvements optionally comprises the following additional features, taken individually or in any combination that the person skilled in the art will understand as being technically compatible:

- the fore flap is displaceable over an angular interval defined so as to be angularly offset relative to the median plane formed by the axes of rotation of the two flaps.
- the fore flap is free to displace under the effect of the wind laterally urging the fore flap.
- the ship further comprises a controller for controlling of the angular displacement of the fore flap.
- the angular interval is comprised between about ±1° and ±15°.
- the ship further comprises a controller for controlling the angulation of the aft flap relative to said median plane.
- the controller is capable of causing distinct angular displacements of a lower region and an upper region of the aft flap.
- the controller is further capable of moving at least one intermediate region of the aft flap.
- the controller comprises a first actuator acting near a lower region of the aft flap and a second actuator located in the lower region of the airfoil and acting near an upper region of the aft flap via a transfer mechanism passing in one of the masts.
- the ship further comprises at least one third actuator acting near an intermediate region of the aft flap by a transfer mechanism passing in a mast of the structure.
- the actuators are mounted on the boom member.
- the gaff member belongs to a gaff assembly comprising said gaff member and a member capable of sliding along the at least one mast and secured in translation with the upper end of the fore flap and/or the upper end of the aft flap, to make at least one among a droppable and/or a reefable fore flap and/or aft flap.

the transfer mechanism combined with the second actuator comprises transfer members mounted on the sliding member of the gaff assembly.

the ship further comprises at least one halyard having a transfer member in the area of the fixed member of the gaff and attached to said sliding member of the gaff assembly.

the ship further comprises an angular controller acting in a region of the foot of the fore mast.

said structure is not shrouded and is capable of turning 360° in response to said angular controller.

at least one of the flaps is made using an assembly of shape members with profiled contours, on which an envelope is stretched.

at least one of the flaps is made using an assembly of generally rigid or semi-rigid boxes engaging telescopically with each other.

In addition, the three improvements can be combined with each other.

BRIEF DESCRIPTION OF THE DRAWINGS

Other aspects, goals and advantages of the present invention will appear more clearly upon reading the following detailed description of a preferred embodiment thereof, given as a nonlimiting example and made with reference to the attached drawings, in which.

DETAILED DESCRIPTION OF PREFERRED EMBODIMENTS

First, with reference to FIGS. 1 to 11, a first embodiment of the invention is going to be described.

a) General Principles

With reference to FIGS. 1, 2 and 3A to 3D, an airfoil according to this embodiment comprises two aerodynamic profiles both adjustable in incidence and for which the relative camber angle is adjustable. In the following, they are called first flap or fore flap, and second flap or aft flap. They are designated by the references 100 and 200 respectively. They pivot on the axes defined by two masts 310, 320 as is going to be seen in the following.

At least one of these profiles has an asymmetric aerodynamic transverse section in the fore-to-aft direction (with leading edge and trailing edge). It can for example involve sections called symmetric aircraft airfoil, and more preferably NACA 00xx standardized sections or others.

The relative angle of the second flap relative to the first flap is differentially adjustable along the height thus allowing a washout of the second flap.

FIGS. 3A to 3D schematically show various positions which can be taken by the two flaps.

The first flap 100 has in the present example one degree of freedom determined by pivoting about a longitudinal plane P of the airfoil (defined by an airfoil structure that is going to be described later), whereas the second flap 200 can be stressed using a sheet system, cylinder or any other system so as to take an inclination relative to the fore airfoil.

Figure 1:
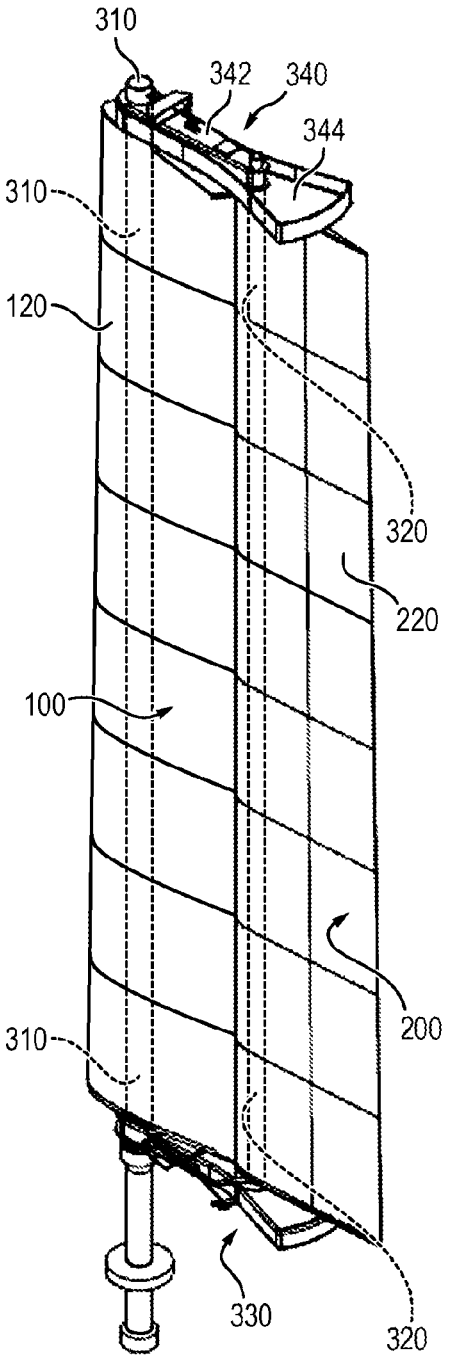
FIG. 1 is an overall perspective view of a sail propulsion airfoil according to a first embodiment of the invention.
Figure 2:
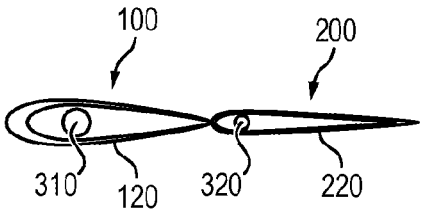
FIG. 2 is a schematic horizontal section view of the airfoil from FIG. 1.
Figure 3A:
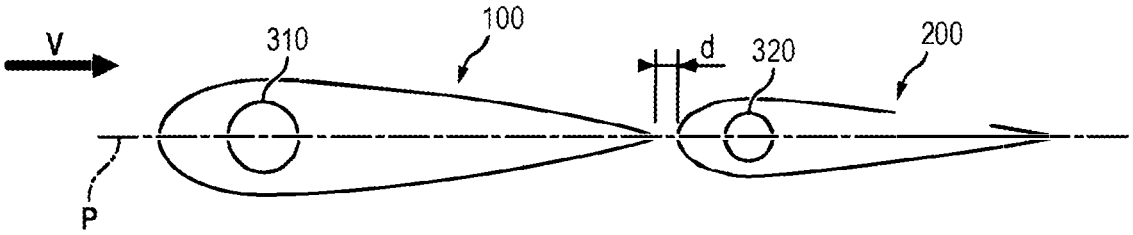
FIGS. 3A to 3D are horizontal section views indicating the state of the airfoil in four different situations.

FIG. 3A shows a headwind (arrow F) position of the airfoil, with the aft flap 200 brought into the median position thereof. The fore flap 100 spontaneously orients according to the axis of the wind and here the aft flap is aligned therewith.

Figure 3B:
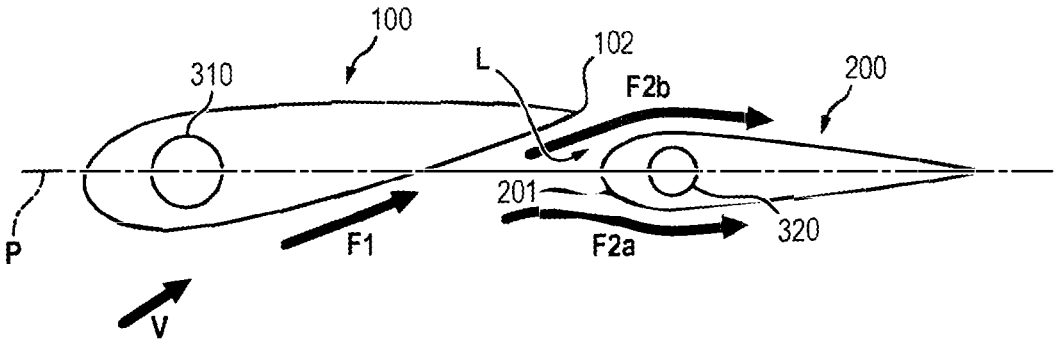

In FIG. 3B, the aft flap is still held in median position relative to the plane of structural symmetry P of the airfoil, but the wind is coming from port. The fore flap 100 is urged by the wind to turn in a counterclockwise direction (seen from above) relative to the plane P to come into stopped angular position as shown. In this position, the airflow (flow F1) along the windward side of the fore flap (surface of the flap located upwind) splits, in the area of the transition between the fore flap and the aft flap, between an inner flow F2*a* on the windward side of the aft flap and a flow F2*b* on the leeward side, which propagates through a vertical opening or slit L defined between the trailing edge 102 of the fore flap 100 and the leading edge 201 of the aft flap 200. Thus, in a particularly simple way and without having to specifically structure the fore flap, the airfoil with two flaps according to the invention can benefit from the effect of the slit and improvement of the aerodynamic yield thereof.

Figure 3C:
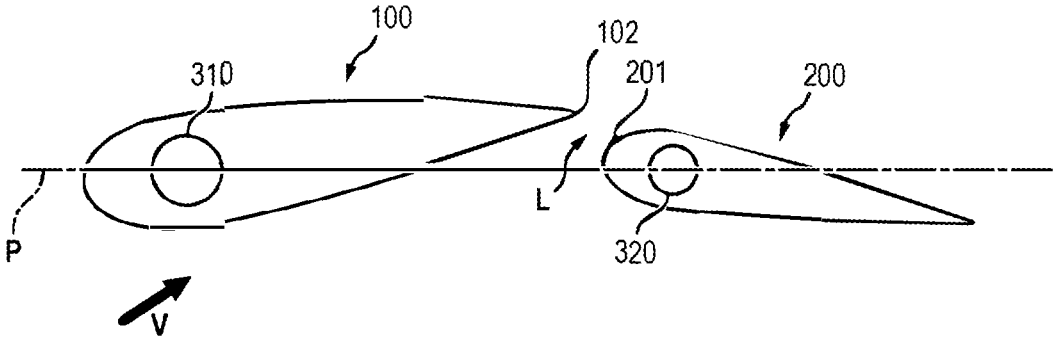

In FIG. 3C, the wind has the same orientation as in FIG. 3B, but the aft flap has been urged to have an inclination towards the wind relative to the plane P of the airfoil.

In this configuration, an effect similar to that of the filling (or camber) of a flexible airfoil is obtained.

Finally in FIG. 3D, it is seen that the aft flap 200 has, because of a twist command that is going to be described in detail later, a difference between the inclination in the lower region 200' thereof compared to the plane P and the inclination of the upper region 200" thereof relative to the same plane P. With this twist, the airfoil can be given a variable camber, which is helpful to improving the performance thereof. More specifically, with this variation an aerodynamic twist of the airfoil (variation of the null lift angle along the length) can be generated so as to either adapt to the wind gradient or to offload the top of the airfoil or even generate an inverse camber so as to increase a righting torque.

Naturally, with a starboard wind, the inverse phenomena can be obtained.

According to an implementation variant, the fore flap 100 is not free, but can be driven so as to adapt a behavior similar to that shown in FIGS. 3A to 3D.

According to the profile and more generally the transverse dimensions of the fore flap 100 and the aft flap 200, the angular interval within which the fore flap 100 is free to move (freely or by command) is typically comprised between ±1° and ±15°.

b) Structure

With reference to FIGS. 4 to 11, the structure of the airfoil according to this first embodiment is now going to be described in detail.

The airfoil comprises a rigid frame 300 formed by the two cylindrical masts 310 and 320, here the outside diameter is constant, rigidly connected to each other by respectively upper and lower transverse structural members 330, 340 respectively forming a boom member and a gaff member. This structural framework is free to turn on itself relative to the structure by bearings connecting it to the mainmast. The members of this structural frame are formed of parts, for example of metal or composite material, sized appropriately depending on the stresses.

It will be noted here in the present embodiment that the fore mast 310 is self-bearing, meaning without shrouds, but it can of course be anticipated that it be equipped with all or part of the following members: shrouds, stays, running backstays, with attachment points at the top of the mast above the structure of the flaps.

In the present example, since the thickness of the aft flap 200 is smaller than that of the fore flap 100, the aft mast 320 can have a smaller diameter than that of the fore mast 310.

A series of fore shape members 110 and a series (preferably the same number) of aft shape members 210 are mounted respectively on the fore mast and aft mast; jointly the members describe an envelope of symmetric aerodynamic profiles intended to form, with respective envelopes 120, 220 (not shown in FIGS. 4 to 7) the first and second flaps 100, 200. These envelopes 120, 220 are made for example in the form of taut coverings on the respective shape members. An aeronautical canvas or fabric of the type used for conventional sails, brought under tension during hoisting, can in particular be used.

In a variant embodiment, not shown, the envelopes 120, 220, or at least one of them, can be discontinuous, i.e. made of two or several envelopes of lesser heights, substantially aligned along the respective flap and separated by gaps of limited height.

The shape members 110, 210 are free in rotation and translation on their respective mast 310, 320. These two degrees of freedom are provided for example by smooth bearings or ball bearings (not shown in FIGS. 4 to 7), intended to allow these movements with reduced friction while avoiding risks of pinching.

Figure 8:
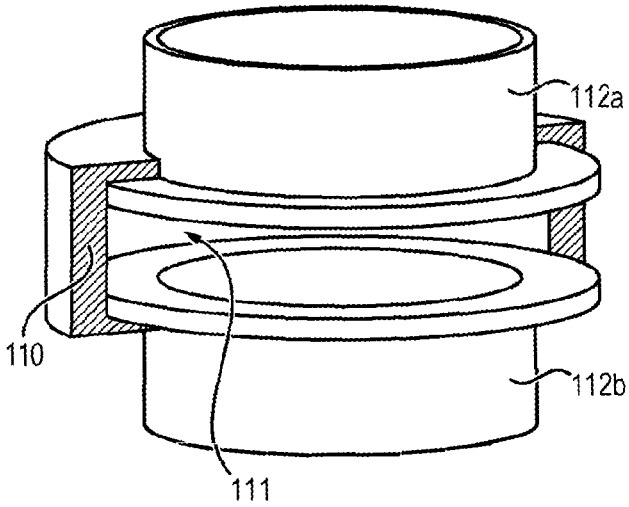
FIG. 8 is a top perspective view of a detail of an member of the airfoil structure.

In the specific example shown in FIG. 8, these bearings comprise two bearing members, respectively 112*a*, 112*b*, enclosed in the upper region and in the lower region of a shape member 110 while surrounding an opening 111 formed in said shape member to allow passage of the associated mast 310.

Generally, the height of the guiding members is chosen to minimize friction and the risk of blocking while giving the airfoil the most compact form possible once dropped.

Because of the translation of the shape members along the respective masts thereof, the two airfoils can be hoisted and hauled down as will be seen in the following and can also be reefed.

The vertical displacement of the shape members 110, 210 and of the respective envelope 120, 220 thereof is done identically on the two masts by making the gaff part 340 in form of a fixed member 342 rigidly secured to the masts 310, 320 and an elevator member 344 capable of sliding along the masts and to which are secured with freedom of rotation the highest shape members (110*a*, 210*a*) of the fore airfoil 100 and the aft airfoil 200, where this sliding member 344 could be hoisted and lowered using a halyard 400 in that way driving each envelope and, progressively, each shape member respectively 110, 210. This connection with freedom of rotation between the shape members 110*a*, 210*a* and the part 344 assures the secure connection in translation of the upper end of the airfoils with said part while also allowing the freedom of movement of the fore flap 100 relative to the gaff 340 within defined angular limits, as described in the preceding, and the freedom of movement of the aft flap 200 angularly urged in inclination by means of provisions that will be described in the following.

In the present embodiment, the halyard 400 is guided by an assembly of transfer pulleys (including a pulley 410 on the top of the fixed member 342 of the gaff assembly 340) and passes through an opening formed in the central region of the fixed part 342 of the gaff 340 for being attached to the central region of the sliding part 344. From the upper region of the airfoil, the halyard 400 runs downward inside of the fore mast 310 after entering it through an opening 312 (see FIG. 11). The lower end of the halyard (not visible) can be manipulated manually or, for the largest dimension airfoils, using a motor (not shown).

Depending on the commands applied to this motor, the airfoil can be hoisted over the full vertical extent thereof and lowered, and also reefed, by positioning the sliding part 344 at some height below the maximum height thereof.

The way in which the shape members, and with them the flaps for which they are the framework, are rotated is now going to be described in detail.

In the present example, the fore flap 100 has, as already said, some degree of angular freedom around the mast 310 thereof. It was however seen that in another embodiment, it could be controlled by a mainsheet or other control member.

Figure 3D:
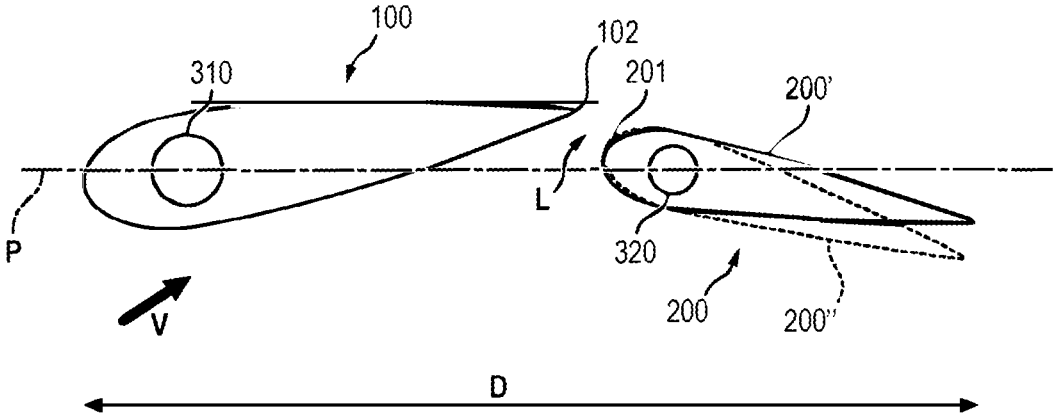
Figure 4:
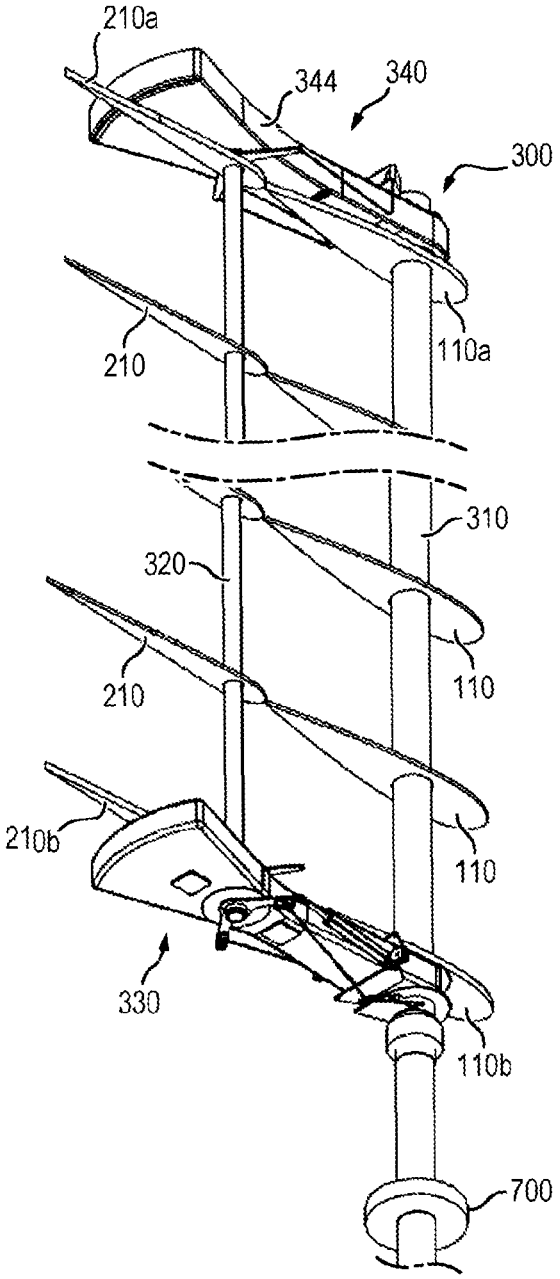
FIG. 4 is a bottom perspective view of the assembly of the airfoil structure without the envelope thereof.

The placement of the fore mast 310 relative to the center of aerodynamic thrust of the flap 100, whatever the incidence of the wind, is such that the flap comes to rest on an angular stop in the clockwise or counterclockwise direction (depending on the side of the incidence of the wind), as shown in FIGS. 3B, 3C and 3D.

Figure 5:
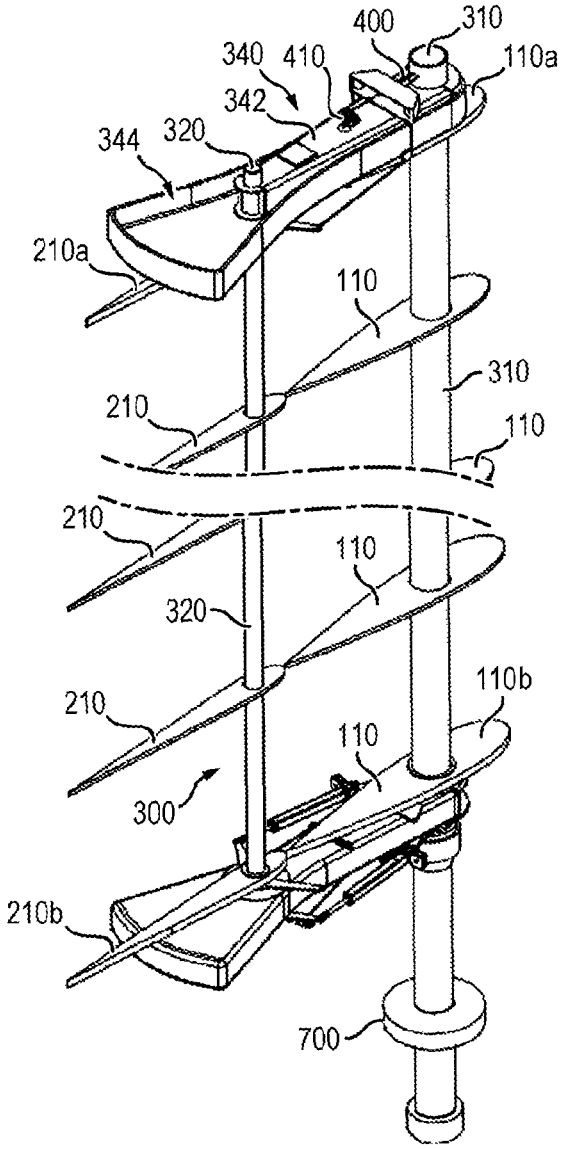
FIG. 5 is a top perspective view of the assembly from FIG. 4.
Figure 5A:
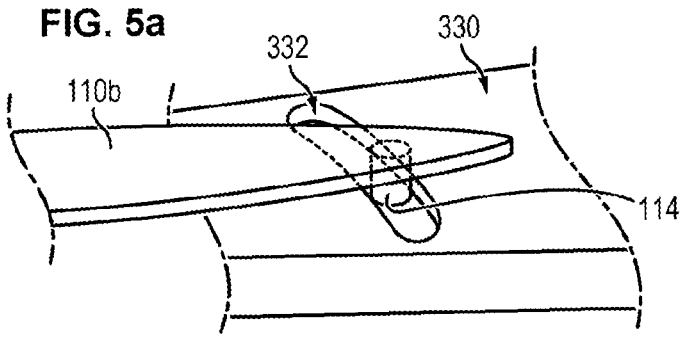
FIG. 5*a* is an enlarged scale top perspective view of a detail from FIG. 5.
Figure 6:
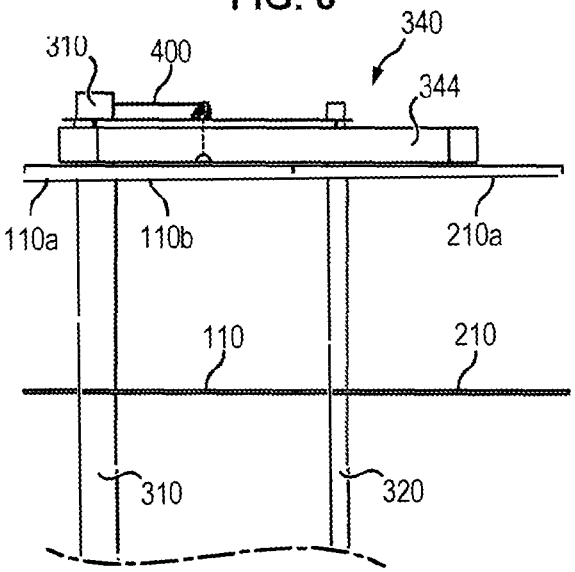
FIG. 6 is a side elevation view of an upper region from the assembly from FIGS. 4 and 5.
Figure 7:
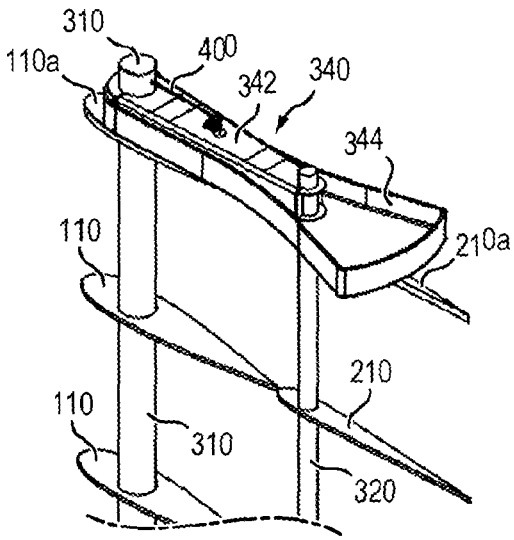
FIG. 7 is a top perspective view of the region shown in FIG. 6.

As shown in FIG. 5*a*, a lower angular stop can be provided by providing a finger 114 projecting from the lowest shape member 110*b* of the fore flap 100 that engages in a throat 332 arranged in a circular sector on the upper surface of the boom 330.

A similar arrangement can be provided between the highest shape member 110*a* of the fore flap and the lower surface of the sliding member 344 of the gaff 340.

Alternatively, a limit on the angular swing of the fore flap 100 can be provided by acting between the mast 310 and the lower shape member 110*b* (respectively the highest shape member 110*a*), or even by using a lanyard with one end attached in the aft region of the lowest shape member 110*b* and the other end on the boom 330. In this case, a corresponding arrangement is provided between the highest shape member 110*a* and the sliding member 344 of the gaff 340.

Figure 27:
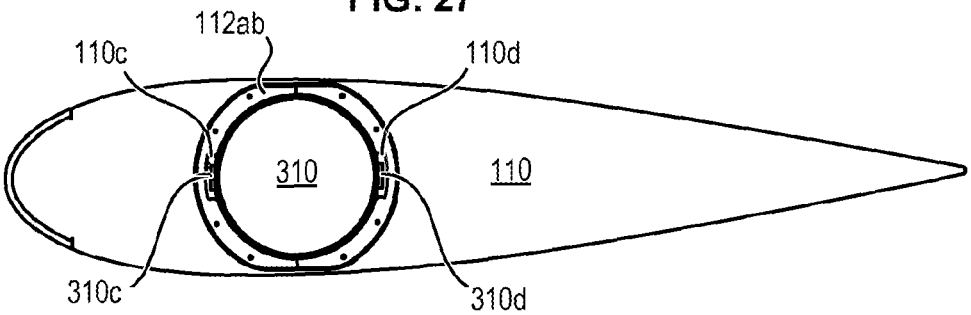
FIG. 27 is a diagrammatic plan view of a fore mast/fore shape member cooperation for defining a range of angular freedom of the fore flap.

In this regard and referring to FIG. 27, an arrangement to restrict the angular mobility of the fore shape members 110 relative to the fore mast 310 comprises at least one longitudinal rib (in this example two opposed ribs 310*a*, 310*b*) provided on mast 310 and capable of cooperating with a pair of longitudinal recesses 110*a*, 110*b* of greater angular width formed in the bearing members 112*a*, 112*b* of the shape members 110. The ribs 310*a*, 310*b* can be integral with the masts or provided on skirts surrounding the respective mast bodies.

According to another variant, a transverse rail can be provided secured to the boom 330 and in which a cart can slide following the aft region of the lowest formed member 110*b* and an equivalent (or different) arrangement can be provided in the upper region of the airfoil.

As indicated above, the aft flap 200 has a degree of freedom in rotation around the mast 320 thereof, but the angular position thereof is driven at least in the lower region thereof, and preferably also in the upper region thereof to be able to control the twist of the flap.

Also, control of the angular position of the flap 200 can also be provided at one or more positions at intermediate heights thereof to be able to locally adjust the camber thereof in that way.

In the present embodiment, the driving of the aft flap 200 is done by subjecting the angular position of the lowest formed member 210*b* thereof adjacent to the boom 330 using a first control means and by subjecting the angular position of the highest formed member 210*a* thereof adjacent to the sliding member 344 of the gaff, relative thereto, using a second control means.

Figure 9:
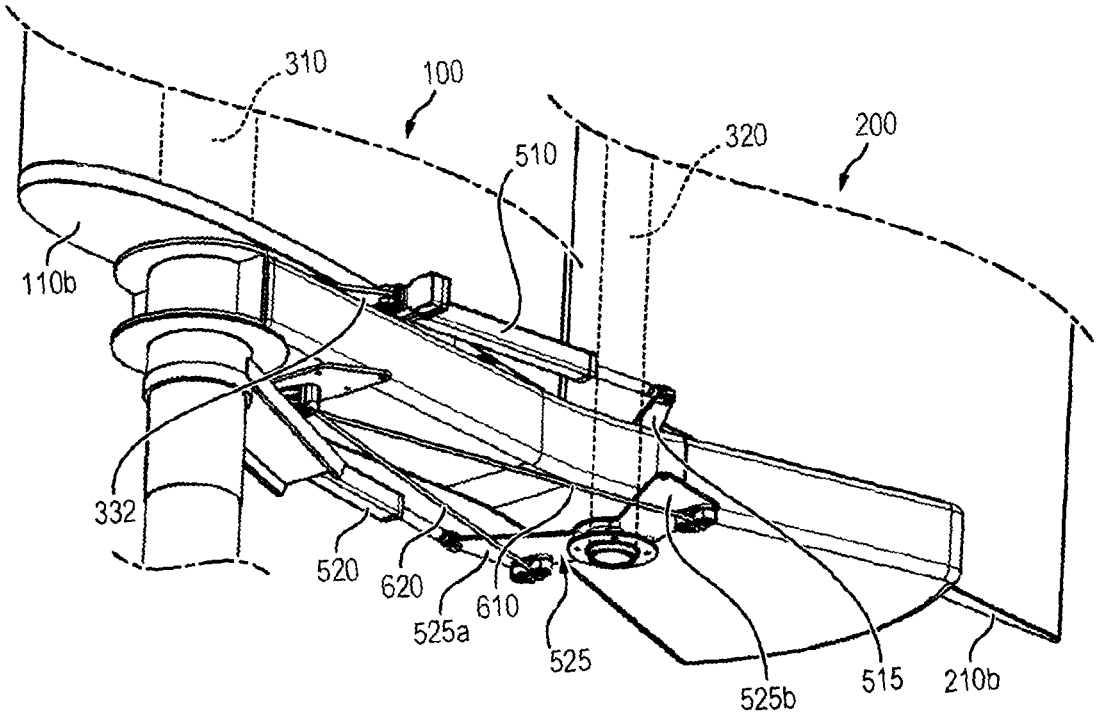
FIG. 9 is a bottom perspective view at enlarged scale of a lower region from the assembly from FIGS. 4 and 5.
Figure 10:
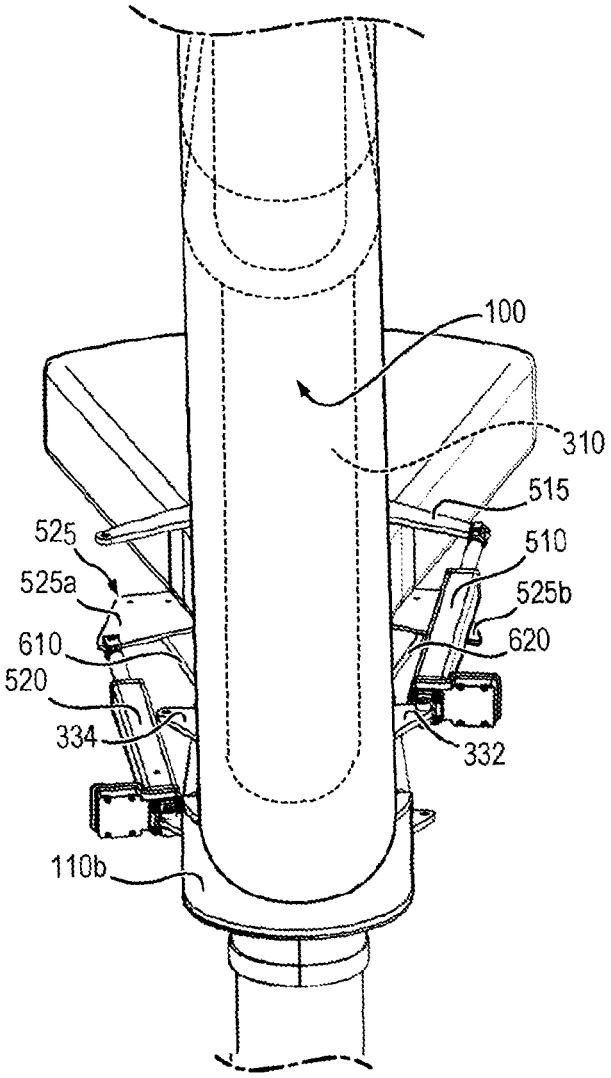
FIG. 10 is a plunging perspective view, in the axis, at enlarged scale, of the region from FIG. 9.

Near the boom 330 and as shown in particular in FIGS. 9 and 10, the driving of the angular position of the shape member 210*b* is done here using a cylinder 510 where the cylinder body is mounted with rotational freedom in the horizontal plane on a plate 332 secured to the boom 330 and whose rod is connected with articulation at the free end of a transfer arm 515 mounted around the mast 320 immediately above the boom member 330 and which is secured in rotation to the shape member 210*b*.

It is understood that by driving the length of the cylinder 510, the angular position of the base of the aft flap is progressively driven to in that way increase or decrease the camber of the airfoil, from one side or the other, depending on the wind and navigation conditions.

To drive the upper region of the aft flap 200, here a second cylinder 520 arranged generally symmetrically from the first cylinder is provided. The body of the cylinder is mounted with freedom of rotation on a plate 334 arranged opposite from the first plate 332. The rod of the cylinder 520 is mounted with articulation on a transfer member 525 mounted pivotably on the lower end of the mast 320 immediately below the boom member 330. This transfer member 525 is made as a single piece and forms two opposed transfer arms 525*a*, 525*b* arranged in a generally transverse direction relative to the boom, where the rod of cylinder 520 is connected to the free end of the first transfer arm 525*a*.

Two transfer lanyards 610, 620 are attached in the region of the respective free ends of the two transfer arms 525*a*, 525*b*. These lanyards, with the help of appropriate transfer pulleys 611, 621, pass inside the fore mast 310 towards the top thereof, come out therefrom through the opening 312 provided for the halyard 400 and are connected there to a second transfer member 530 generally identical to the member 525 and arranged between the sliding member 344 of the gaff 340 and the highest shape member 210*a* by being secured in rotation with said shape member.

In that way, using the cylinder 520 and from the region of the boom it is possible to control the angular position of the highest shape member 210*a* of the aft airfoil 200, to in that way selectively create a twist of the aft airfoil and in that way progressively vary the camber of the airfoil between the fore flap 100 and the aft flap 200 over the height thereof.

To allow the guiding with the help of the lanyards 610, 620, whatever the height of the sliding member 344 of the gaff 340, including a reefed position, a mechanism for adjustment of the length of the lanyards 610, 620 between their attachment points thereof on the respective transfer members 525, 530 thereof is provided.

In the case of a light airfoil, this adjustment can be done manually, for example near the lower transfer member 525 by means of jamming cleats. In a larger dimension system, actuators, for example electric, are provided with which to selectively release and retain lanyards in the area of said transfer member 525.

Further, the cylinders 510, 520 can be replaced by other devices suited to the size of the airfoil system. In particular, for airfoils sized for light craft, a system of lanyards with jamming cleats can be provided, if necessary without the aforementioned guiding members or with guiding members or levers arranged differently.

As was indicated above, the assembly formed by the rigid structure (masts 310 and 320, boom member 330 and fixed member 342 of the gaff 340) can be adjusted angularly (trimmed/slackened) about the axis of the craft by turning the fore mast 310 on itself.

In a first embodiment, this rotation can be implemented by means of a hollow shaft motor with reduction gear (not shown) mounted at the base of the mast 310 coaxially therewith.

Figure 24:
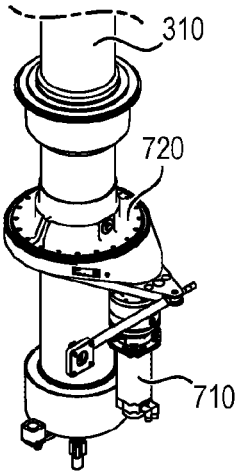
FIG. 24 is an enlarged perspective view of a detailed embodiment of an airfoil orientation control mechanism, FIGS. 25*a* and 25*b* diagrammatically illustrate the selective reefing of the flaps with the airfoil of FIGS. 15-24.

In a second embodiment, the command can be made at a distance from the mast by using a transmission such as a pulley 700 (possibly notched) secured to the mast 310 in the lower region thereof (see FIGS. 4 and 5) and connected to a control mechanism (manual, electrical, hydraulic, etc.) via a belt, a gearing, etc. In a particular embodiment, as shown in FIG. 24, the device for rotating mast 310 comprised a gearmotor 710 engaging a toothed wheel 720 coaxial with the mast.

Finally, in particular for light sector board type craft or small pleasure boats, a sheet and tackle can be simply provided analogously to the control of a traditional mainsail. The lashing is then done in the area of the aft region of the boom member 330.

In every case, to be sure that the rigid frame made up of the two masts 310, 320, the boom member 330 and the fixed member 342 of the gaff 340 turns as a whole during this angular adjustment, the members 330, 342 are mounted on the fore mast 310 so as to be secured therewith in rotation.

In summary, a double-flap airfoil is thus proposed according to the present invention which allows automatically (without specific adjustment) benefiting from a slit effect between the fore flap and the aft flap.

Further, an airfoil according to the invention can be made droppable and reefable extremely easily by means of a single halyard controlled manually or by motor.

More generally, operation of the airfoil (general orientation, camber, variation of the camber) can be easily driven by means of actuators, and automated.

In this respect, some number of sensors and an onboard calculation center can be combined with this airfoil in order for this automation.

In particular Harken, Pewaukee, Wis. USA proposes automatic sail control systems which can be adapted to an airfoil according to the present invention by the person skilled in the art.

Figure 12:
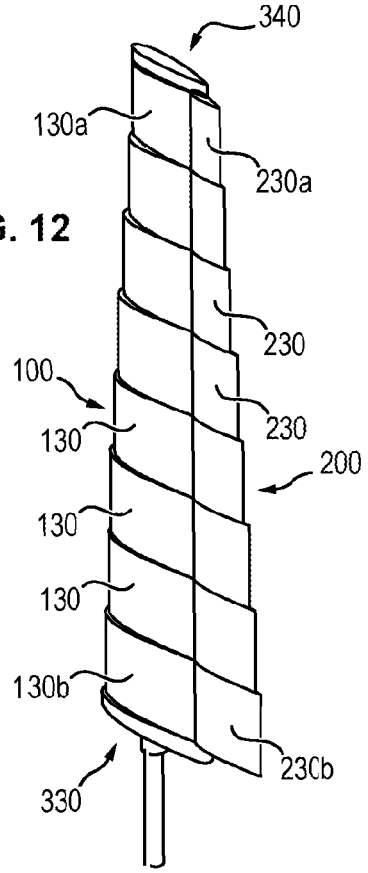
FIG. 12 is a schematic perspective view of an airfoil according to a second embodiment of the invention.
Figure 13:
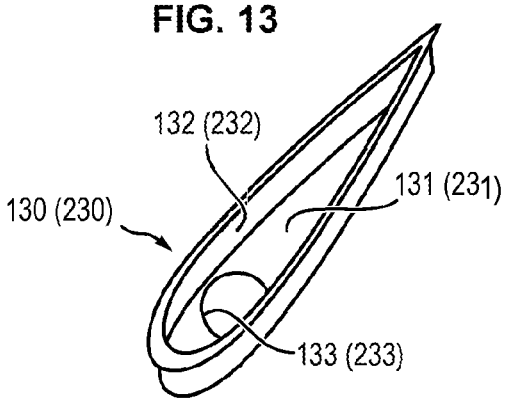
FIG. 13 is a perspective view of a structural member of the airfoil from FIG. 12.
Figure 14:
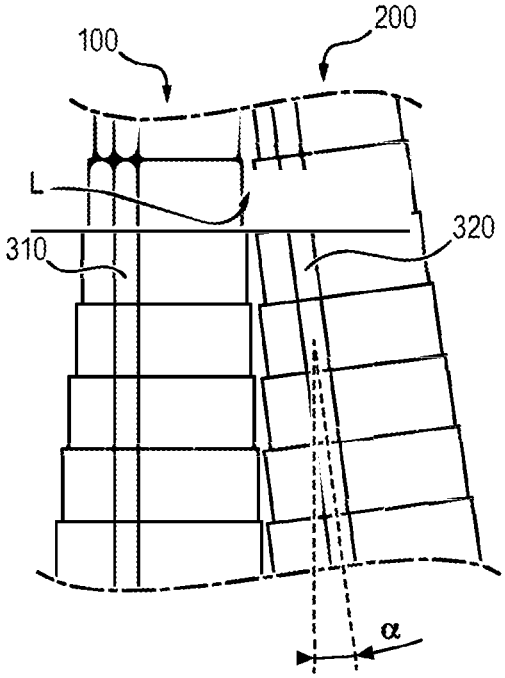
FIG. 14 is a schematic view in side elevation of the airfoil from FIG. 12.
Figure 15:
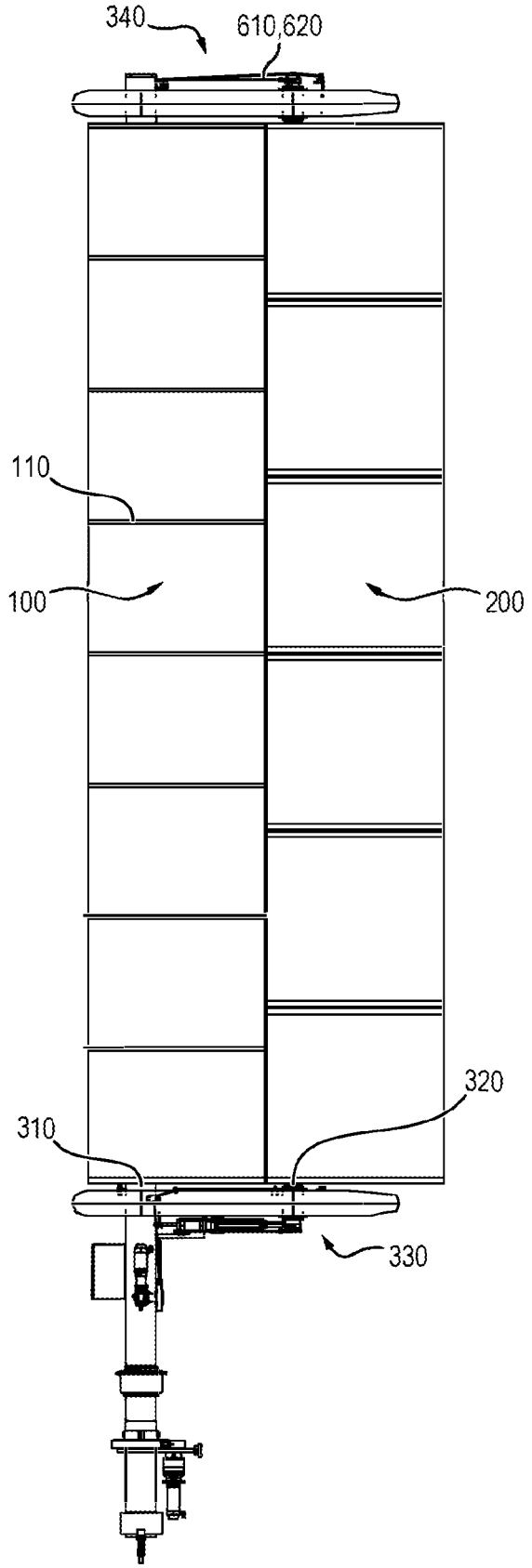
FIG. 15 is a side view of an airfoil according to a third embodiment of the invention.
Figure 16:
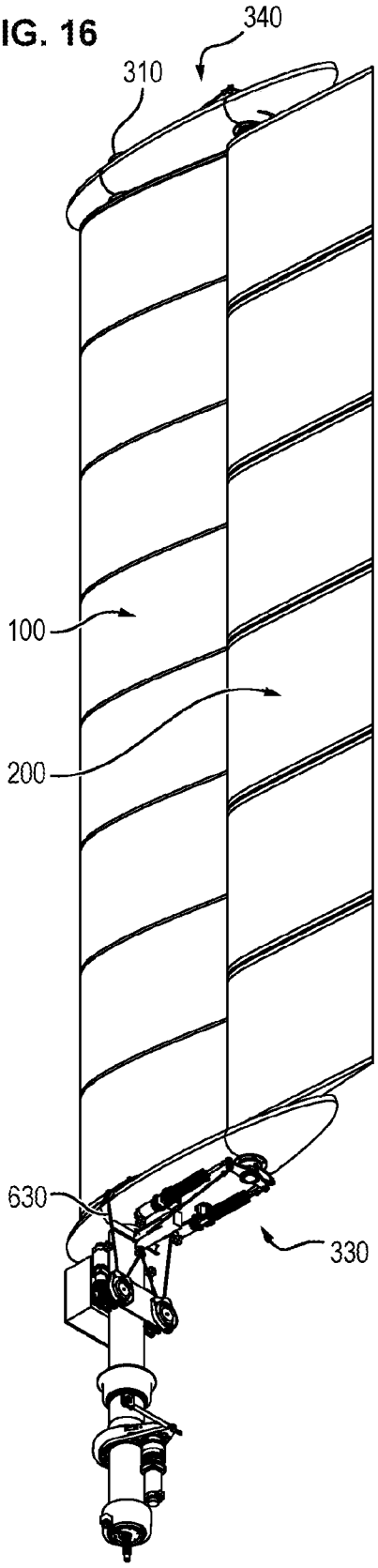
FIGS. 16 and 17 are perspective views from the top and from the bottom of the airfoil or FIG. 15.
Figure 17:
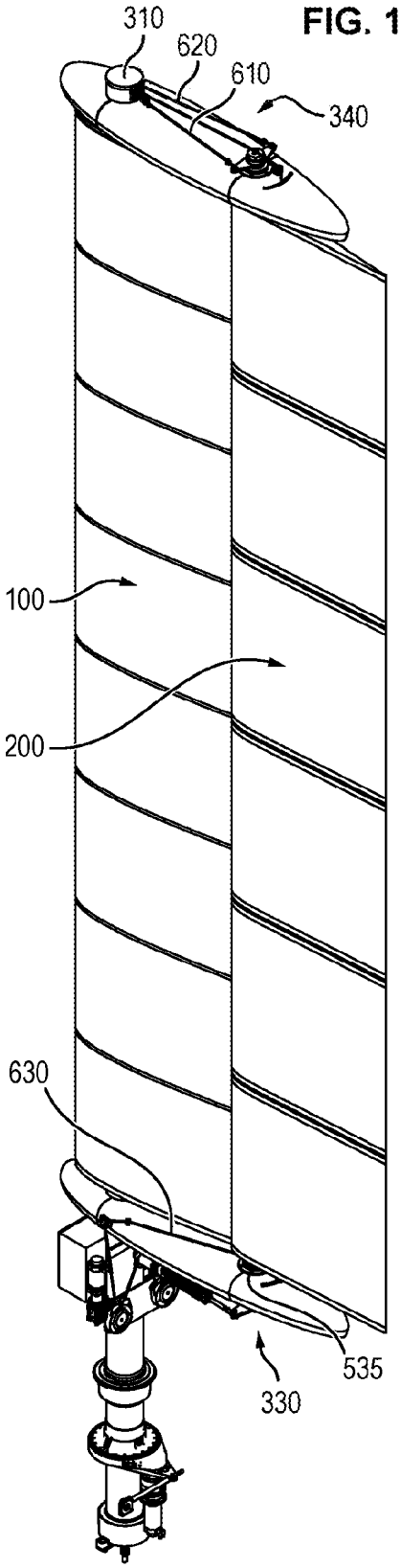
Figure 18:
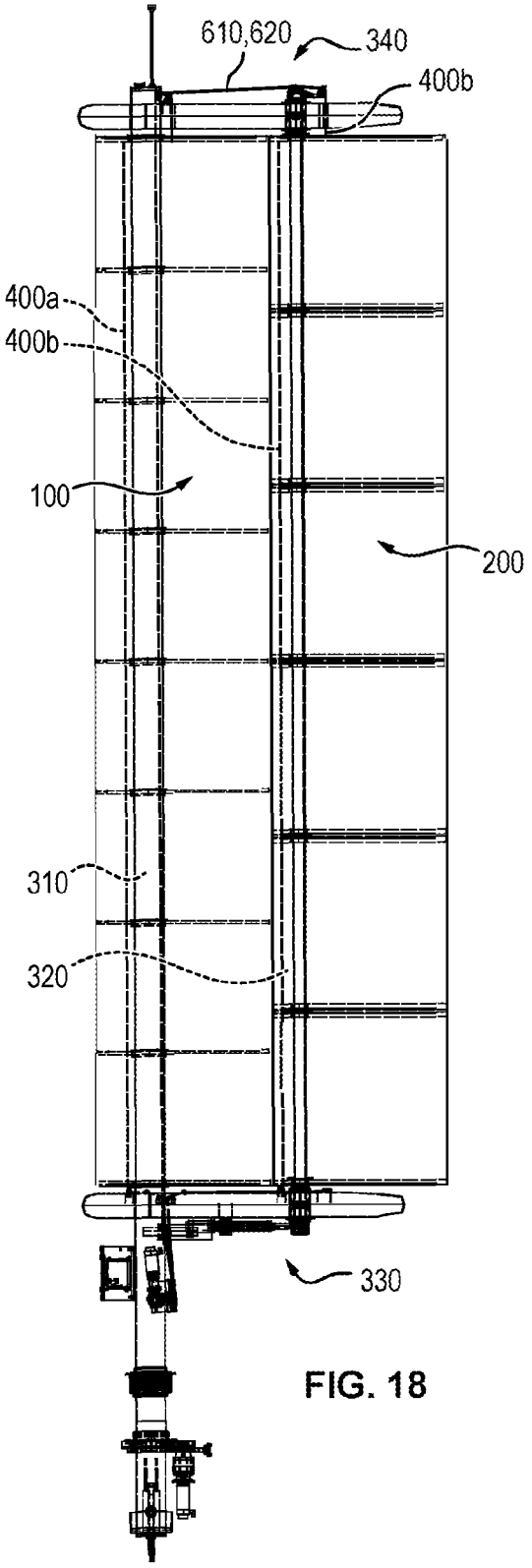
FIG. 18 is a side sectional view of the airfoils of FIGS. 15-17, FIGS. 19 and 20 are a partial perspective views from two different viewing angles of the boom region of the airfoil of FIGS. 15-18, without the flap envelopes.
Figure 19:
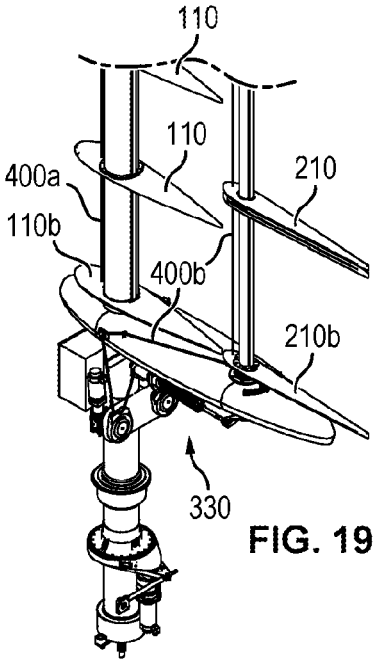

With reference to FIGS. 12 to 14, a second embodiment of the flaps of an airfoil according to the invention is now going to be described. In this second embodiment, each flap 100, 200 is made by telescopically nesting a series of generally rigid box type shape members, respectively 130, 230, each having (see FIG. 13) a generally U-shaped vertical section with a bottom (respectively 131, 231) and a rising peripheral wall (respectively 132, 232), where each member is slightly smaller than the member located immediately below so as to be able, depending on the applied stresses, to occupy relative to it a released position or a position where it is enclosed in it. Other vertical sections allowing nesting of the members can be considered.

The bottoms 131 of the shape members 130 each have an opening 133 through which the fore mast 310 extends. In the same way, the bottoms 231 of the shape members 230 each have an opening 233 through which the aft mast 320 extends. Preferably these openings are provided with guiding rings or analogs, for example in a way similar to what is shown in FIG. 8 concerning the shape members from the first embodiment. In this way, the masts 310, 320 serve as guides for the respective boxes in order to avoid pinching thereof during mutual movements thereof.

Further, not shown, two adjacent boxes are equipped with stop means (flanges, rims, fingers or others) so as to avoid one box becoming completely separated from the other.

In the lower region of the airfoil, the lowest boxes 130*a*, 130*b* are secured in vertical translation to the boom member 330 whereas in the upper region of the airfoil, the highest boxes 130*b*, 230*b* are secured in vertical translation to the sliding member 344 of the gaff 340.

In that way, displacement of the sliding member 344 by the halyard 400 serves to hoist the airfoil with the boxes from the fore airfoil and aft airfoil deploying progressively upward during this hoisting.

Hauling down is done by inverse movements, the total height of the airfoil after dropping is substantially equal to the height of one box.

In the same way as previously, reefing is possible by bringing the sliding member 344 to an intermediate height above the boom 330.

The variable camber of the airfoil, achieved as was seen because of a twist of the aft flap 200, can be allowed here by making the boxes from a semi-rigid material allowing some degree of elastic deformation of the boxes between the bottom point thereof and the top point thereof. Alternatively or in addition to this arrangement, some play can be provided between the base of one box and the open upper end of the box located immediately below.

The lower box 130*b* of the fore flap preferably has a freedom of movement in a preset angular range in the same way as the lowest shape member 110*b* of the fore flap 100 from the first embodiment. The upper box 130*a* of the fore flap also has this freedom in the same way as the highest shape member 110*a* of the fore flap 100 from the first embodiment.

Correspondingly, the lowest box 230*b* and the highest 230*a* of the aft flap 200 are urged in the same way as the lowest shape member 210*b* and the highest shape member 210*a* respectively of the aft flap 200 of the first embodiment.

As shown in FIG. 14, the fore mast 310 and the aft mast 320 preferably have a slight mutual inclination to keep a generally constant width of slit L between the fore flap and the aft flap despite progressive reduction of the transverse section of the flaps (inherent in their telescopic structure) from bottom to top.

In another embodiment, a mechanism can be provided for horizontal translation of the boxes over a short distance, once they are released from each other or during an end of range of the release movement, in order to at least approximately align the trailing edges of the fore flap and the leading edges of the aft flap, to in that way keep an essentially constant slit width.

According to yet another embodiment, it can be provided that the flaps are constituted of one or more airtight envelopes inflatable by section or as a whole. With this approach the airfoils can be stiffened in the position thereof for use. The shape members 110, 210 can be adapted as a consequence, for example by constraining the respective airfoil section by ribs which then play the role of shape members. For inflation as a whole, the shape members are then not sealed and are designed for allowing air to pass vertically along the flap.

Another embodiment of the present invention will now be described.

In this embodiment, elements, parts or portions identical or similar to the ones of the previous embodiments will bear as far as possible the same reference signs and will not be described again.

Figure 25B:
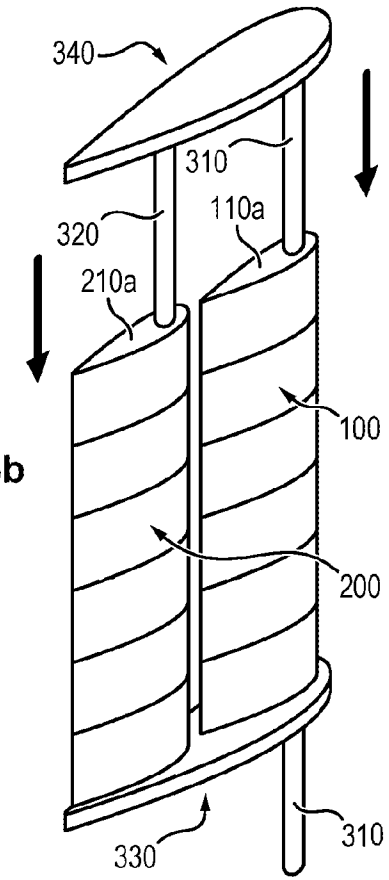
Figure 25A:
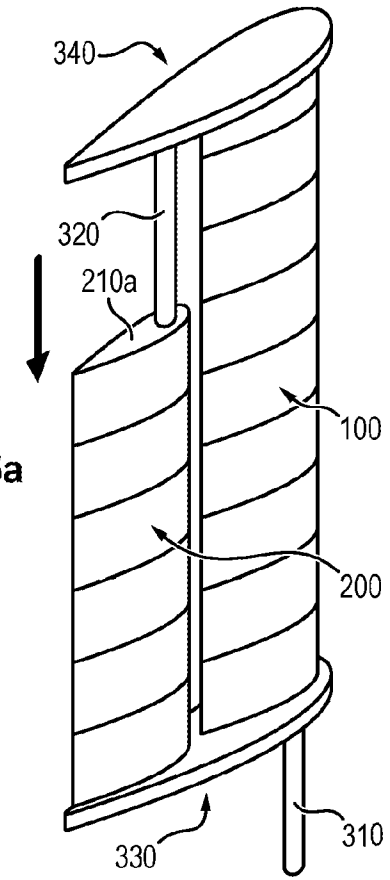

Referring now to FIGS. 15-24, an aim of this embodiment is to offer the airfoil a capacity of independent controlling (manual or motorized), hoisting, hauling down and reefing of the fore flap and the aft flap, respectively, as particularly shown in FIGS. 25*a* and 25*b*, while keeping the possibility of twisting the aft flap.

Figure 11:
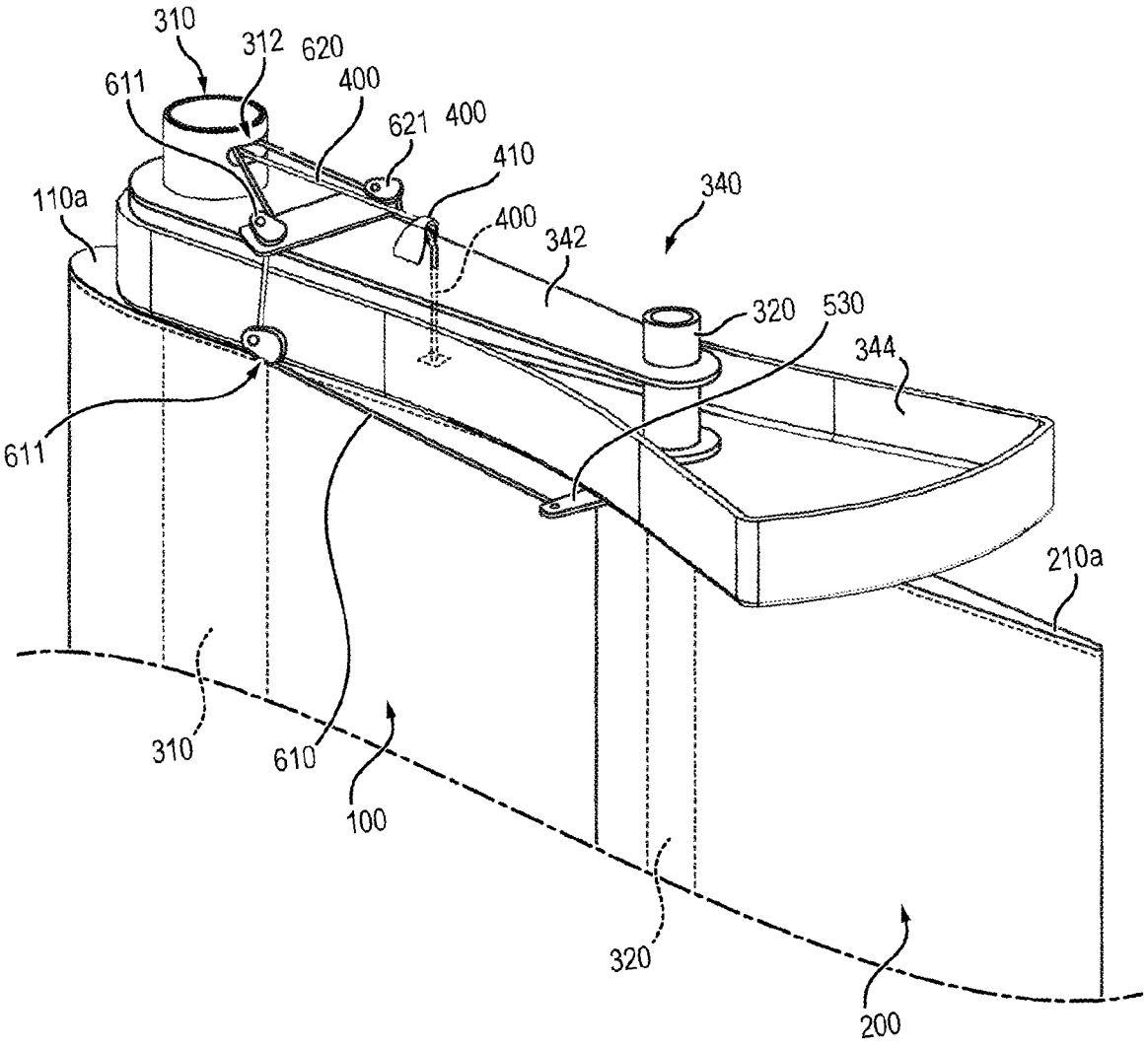
FIG. 11 is a perspective view at enlarged scale of the region from FIGS. 6 and 7.

In this regard, it is reminded that the control of the top and bottom shape members of the aft flap as provided in the first embodiment and illustrated in FIGS. 9-11, requires an elevator member 344 which is common to the fore and aft flaps.

According to the present embodiment, the fore and aft flaps can be independently controlled it terms of hoisting, hauling down and reefing by means of respective halyards 400A, 400B.

Both halyards are of the loop type, i.e. without the need for furling. Halyard 400A for the fore flap 100 is driven by a first pulley 430A powered by a gearmotor 420A, both mounted on a support structure 440 at the base of the fore mast 310 (cf. FIG. 22). From this gearmotor, halyard 400A travels inside the fore mast 310, exits from an opening provided with a pulley at the top of the fore mast and is directed to the top shape member 110*a* of the fore flap 100 via another pulley and an opening provided in the gaff 340. Halyard 400A is attached to said shape member 110*a* and, from there, travels along the fore mast, through a plurality of openings formed in the successive shape members 110 and ultimately 110*b*. From there it is redirected by appropriate pulleys around the boom and toward driving pulley 430A.

Halyard 400B for the rear flap 200 is driven by a second pulley 430B powered by a gearmotor 420B and also travels inside the fore mast 310, and is then guided along the top of gaff member 340 and then downwardly inside said member. It is attached to the top shape member 210*a* of the aft flap and then continues through a plurality of openings formed in the successive shape members 210 and ultimately 210b. From there it redirected by appropriate pulleys around the boom and rearwardly, toward driving pulley 430B.

It will be understood that by individually actuating motors 420A, 420B, the fore and aft flats can by hoisted, hauled down and reefed independently from each other.

In order to allow the aft flap to be hoisted at different heights while allowing its twisting, the twisting is applied in this embodiment not to the top and bottom shape members 210*a*, 210*b* of the aft flap like in the first embodiment, but directly to the aft mast 320.

The capacity of twisting of the mast itself can be ensured either by selecting a material for the mast body that can endure a given degree of twisting (typically an appropriate composite material), or by providing around the mast body an outer skirt that can slide around the mast body and can be subjected to twisting.

Figure 20:
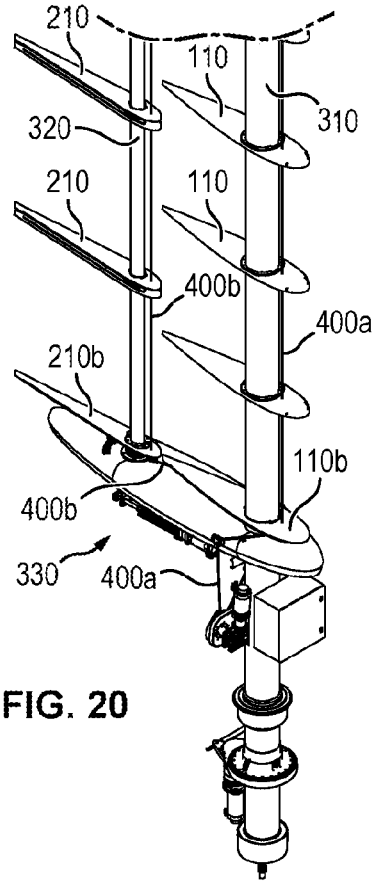

The twist control, in a manner similar to the first embodiment, relies on a pair of cylinders 510, 520 arranged under the boom member 330. As shown in FIG. 20, a first cylinder 510 is capable of driving the bottom of aft mast 320 through a first transfer plate 515 which, contrary to the first embodiment, is located below the boom member 330. Plate 515 is in direct connection with the bottom end of mast 320 which extends through the boom thickness, so as to induce a rotational movement thereof in a direction or the other.

A second cylinder 520 is capable of driving the top of the aft mast 320 via a control plate 525 with control arms 525*a*, 525*b* connected to respective lanyards 610, 620 (not shown in FIG. 20), much like in the first embodiment.

Figure 21:
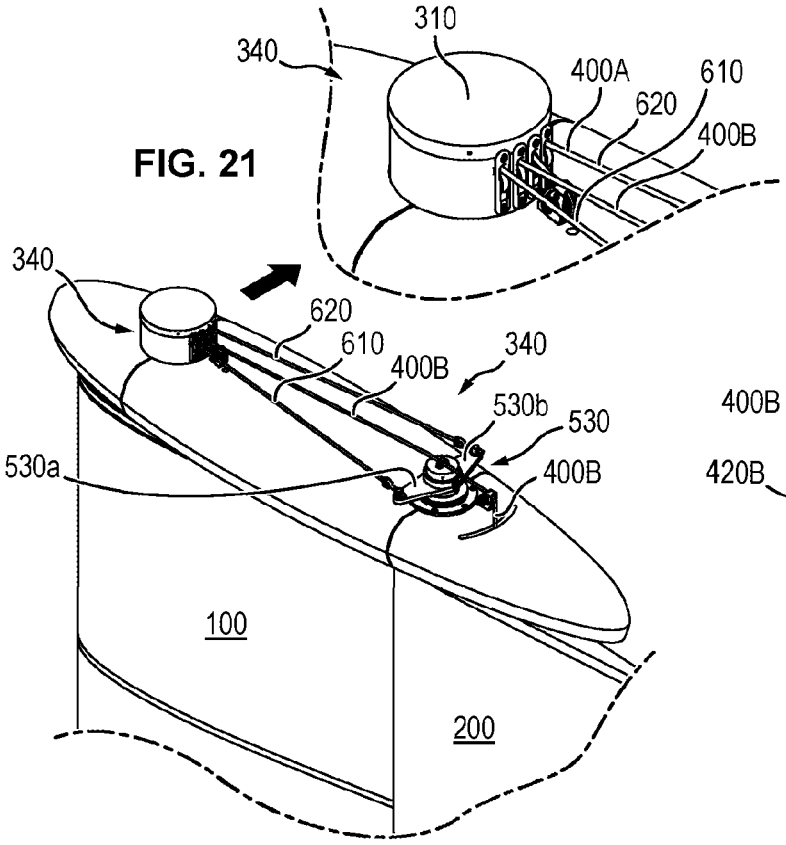
FIG. 21 is an enlarged and partial perspective view of the gaff region of the airfoil of FIGS. 15-20, FIGS. 22 and 23 are enlarged and partial perspective views of the boom region of the airfoil of FIGS. 15-20.
Figure 22:
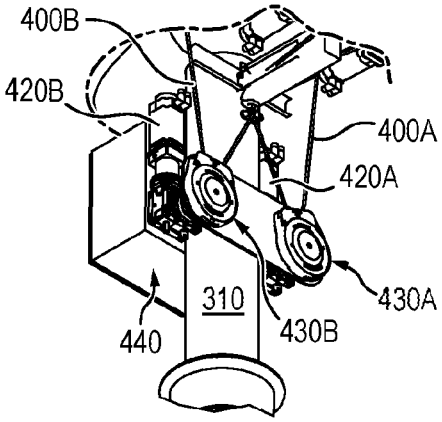
Figure 23:
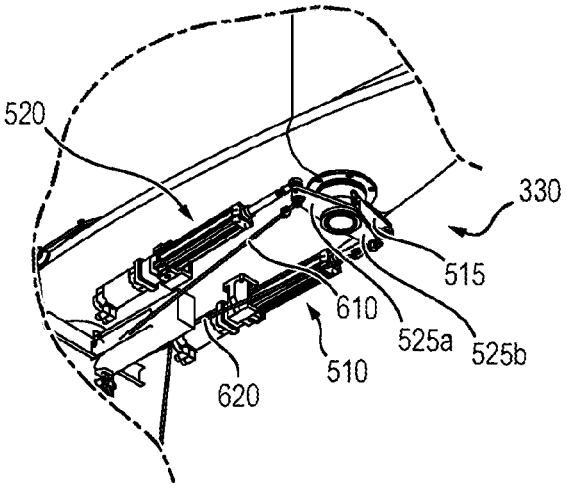

These lanyards travel though the fore mast 310 and, as shown in FIG. 21, connect to transfer plate 530 which is provided with similar transfer arms 530*a*, 530*b* and which is rigidly connected (at least rotationwise) with the top of the aft mast.

By controlling cylinders 510, 520 in directions that cause the same rotation at the bottom and at the top of the aft mast 320, the latter, together with its flap as will be explained in the following, can be caused to adopt the desired orientation according to the sailing conditions.

By providing a differential control of the cylinders, a twisting of the aft flap can be provided in addition to this orientation control.

In a non-illustrated variant embodiment, the angular control of the bottom and top regions of the aft mast 320 can be performed by means of respective motors acting of the respective mast regions through direct drive or through appropriate gearing.

Figure 26:
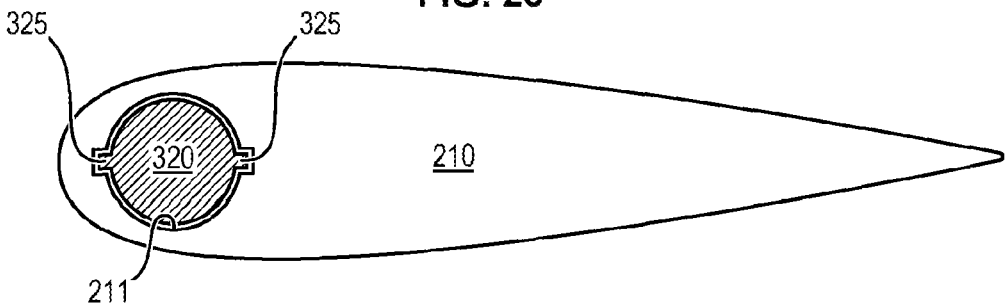
FIG. 26 is a diagrammatic plan view of an aft mast/aft shape member cooperation for a mutual angular locking.
Figure 28:
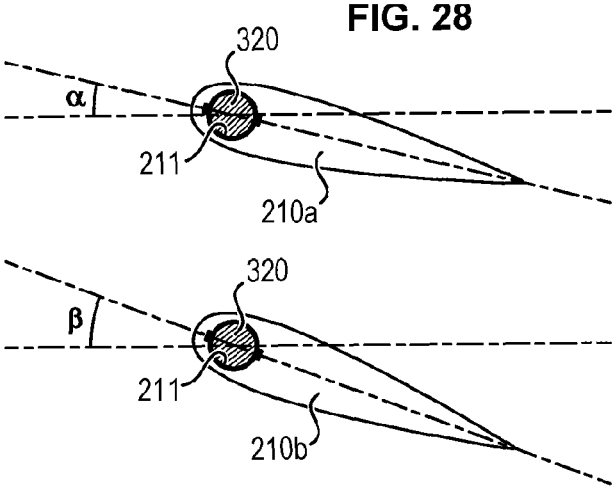
FIG. 28 illustrates by two plan views the twisting of the aft flap of the air foil of FIGS. 15-24.

Now referring to FIGS. 26 and 28, the cooperation between the aft mast 320 and the shape members 210 is illustrated.

FIG. 26 shows that the mast 320 has a constant, non-circular cross-section, with two diametrally opposed, longitudinal ribs 325 extending along the full height of the mast.

Each of the shape members 210 has (preferably in a bearing part or portion thereof) an aperture 211 of a complementary shape, with two diametrally opposed recesses 215 in which engage the respective ribs 325. In this manner the shape members 210 and the aft mast 320 are locked together rotationwise, while allowing the shape members 210 to slide along the mast for hoisting, hauling down and reefing purposes.

FIG. 26 illustrate how the aft flap twisting is performed: cylinder 520 is controlled so as to generate an angular shift of the top part of mast 320 (and thus top shape member 210*a*) through an angle $\alpha$ relative to the longitudinal axis of the boat, while cylinder 510 is controlled so as to generate an angular ship of the bottom part of mast 320 through an angle $\beta$ relative to the same longitudinal direction. A twist is thus generated, while bringing the aft flip to an average angle comprised between these two angles relative to the fore-aft direction.

It will be easily understood that the angular locking between the aft mast and the shape members 210 can rely on completely different non-purely circular shapes.

Figure 29:
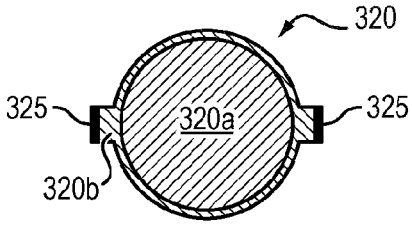
FIG. 29 illustrates an alternative construction of an aft mast.

FIG. 29 illustrate a variant embodiment of the mast 320, which comprises a main mast body 320*a* surrounded by a skirt or sleeve 320*b* which can freely rotate around body 320*a*.

The material properties and the thickness of the sleeve 320*b* allow finely tuning the twisting properties thereof, so as to achieve the same aft flap twisting as described above while keeping a main mast body 320*a* of suitable rigidity.

It should be noted that a principle similar to the one illustrated in FIGS. 28 and 28 can be used for limiting the angular displacement of the fore flap relative to the fore mast 310, as illustrated in FIG. 27. This can be achieved e.g. by providing on the fore mast 310 a pair of ribs 310*c*, 310*d* cooperating with wider (in the angular direction) recesses 110*c*, 110*d* provided in the shape members 110 of the fore flap 100.

Of course, the present invention is in no way limited to the embodiments described above and illustrated in the drawings; the person skilled in the art will know how to make many variants or modifications to it.

In particular, the person skilled in the art will be able to imagine any combination of the various embodiments and variants described here.

Further, from the teachings of the preceding description, the person skilled in the art will know how to make an airfoil having three or more flaps according to the same principles.

According to another variant, it can be provided that each flap or one of the flaps (typically the aft flap) be realized in several parts such that the angular offset of each part relative to those nearby serves to make a washout in particular in the area of the rear flap.

Further, one airfoil with two flaps according to the invention can advantageously equip any type of craft: leisure boats, dinghies or light multihulls, racing boats, container ships for achieving fuel savings, mixed motorized and sail propulsion cruise ships, etc.

The invention claimed is:

1. A double airfoil for a ship, said double airfoil mounted on a structure controlled angularly around a generally vertical axis by a controller depending on conditions, where the double airfoil comprises a fore flap and an aft flap at least one of which has a fore-to-aft asymmetry and separated by a slit, where each flap comprises a series of shape members distributed in height, wherein said structure comprises a fore mast and an aft mast connected by a boom member and by a gaff member, wherein the shape members of the fore flap are traversed by the fore mast while being able to turn around an axis defined thereby, wherein the shape members of the aft flap are traversed by the aft mast while being able to turn around an axis defined thereby, and wherein said structure is capable of turning on an axis of rotation formed by the fore mast, wherein each of the fore and aft flaps comprise a top member capable of sliding along its respective mast independently of the other, and in that it further comprises two halyards capable, in use, of independently hoisting, hauling down and reefing the fore and aft flaps.

2. The double airfoil according to claim 1, wherein the aft mast is twistable, wherein the shape members of the aft flap are rotationally locked to said aft mast, and wherein the controller is capable of acting on the bottom and the top of the aft mast.

3. The double airfoil according to claim 1, wherein the fore flap is displaceable over an angular interval defined so as to be angularly offset relative to a median plane formed by the axes of rotation of the two flaps.

4. The double airfoil according to claim 3, wherein the fore flap is free to displace under the effect of the wind laterally urging the fore flap.

5. The double airfoil according to claim 3, wherein said controller is capable of controlling of the angular displacement of the fore flap.

6. The double airfoil according to claim 3, wherein the angular interval is comprised between about ±1° and ±15°.

7. The double airfoil according to claim 3, further comprising a wherein said controller for is capable of controlling the angulation of the aft flap relative to said median plane.

8. The double airfoil according to claim 7, wherein the controller is capable of causing distinct angular displacements of a lower region and an upper region of the aft flap.

9. The double airfoil according to claim 8, wherein the controller is further capable of moving at least one intermediate region of the aft flap.

10. The double airfoil according to claim 8, wherein the controller comprises a first actuator acting near a lower region of the aft flap and a second actuator located in the lower region of the airfoil and acting near an upper region of the aft flap via a transfer mechanism passing in one of the masts.

11. The double airfoil according to claim 10, further comprising at least one third actuator acting near an intermediate region of the aft flap by a transfer mechanism passing in a mast of the structure.

12. The double airfoil according to claim 10, wherein the actuators are mounted on the boom member.

13. The double airfoil according to claim 1, wherein said controller is capable of angularly controlling the fore mast in a foot region thereof.

14. The double airfoil according to claim 13, wherein said structure is not shrouded and is capable of turning through 360° in response to said angular controller.

15. The double airfoil according to claim 1, wherein at least one of the flaps comprises an enveloped stretched over the respective series of shape members, said shape members having profiled contours.

16. The double airfoil according to claim 1, wherein at least one of the flaps is made using an assembly of generally rigid or semi-rigid boxes engaging telescopically with each other.

* * * * *